US005658377A

United States Patent [19]

Craig

[11] Patent Number: 5,658,377

[45] Date of Patent: Aug. 19, 1997

[54] STABLE HIGH SOLIDS AQUEOUS DISPERSIONS OF HYDROPHOBIZING AGENTS

[75] Inventor: Daniel Horace Craig, Niskayuna, N.Y.

[73] Assignee: Ennis Herder, Inc., Schenectady, N.Y.

[21] Appl. No.: 590,089

[22] Filed: Jan. 24, 1996

[51] Int. Cl.[6] ..... C09D 105/00

[52] U.S. Cl. ..... 106/162.1; 106/172.1; 106/174.1; 106/271; 524/27; 524/46

[58] Field of Search ..... 106/162.1, 174.1, 106/172.1, 271; 524/27, 46

[56] References Cited

U.S. PATENT DOCUMENTS

| | | |
|---|---|---|
| 2,172,392 | 9/1939 | Kress et al. . |
| 2,536,018 | 1/1951 | Schoenholz et al. . |
| 2,627,477 | 2/1953 | Downey . |
| 2,658,004 | 11/1953 | Eldridge et al. . |
| 3,432,319 | 3/1969 | Jakaitis et al. . |
| 3,442,676 | 5/1969 | Belfort . |
| 3,931,069 | 1/1976 | Lundin . |
| 4,296,012 | 10/1981 | Okumichi et al. . |
| 5,013,775 | 5/1991 | Oikawa et al. . |
| 5,028,236 | 7/1991 | Kortman et al. . |
| 5,403,392 | 4/1995 | Craig . |

FOREIGN PATENT DOCUMENTS

| | | |
|---|---|---|
| 82101095 | 5/1982 | Japan . |
| 82101096 | 5/1982 | Japan . |
| 82112498 | 7/1982 | Japan . |
| 82112499 | 7/1982 | Japan . |
| 83087395 | 5/1983 | Japan . |
| 83087396 | 5/1983 | Japan . |
| 83091894 | 5/1993 | Japan . |
| 83091895 | 5/1993 | Japan . |

*Primary Examiner*—David Brunsman

[57] ABSTRACT

Stable high solids aqueous dispersions of hydrophobizing agents can be prepared utilizing combinations of water-soluble protective colloids in combination with hydrolytically stable water-insoluble organic compounds selected from the group comprising organic salts and polar group-containing organic compounds as dispersion stabilizers. These dispersions impart water repellent characteristics when applied to the interfaces and surfaces of materials, and are compatible when blended with synthetic resin emulsions.

18 Claims, No Drawings

STABLE HIGH SOLIDS AQUEOUS DISPERSIONS OF HYDROPHOBIZING AGENTS

This invention relates to high solids aqueous dispersions of hydrophobizing agents, to methods of their preparation, and to aqueous blends of such dispersions. The high solids dispersions of this invention impart hydrophobic characteristics to the interfaces of materials onto which they are applied, are stable to storage, and are compatible with a variety of other aqueous systems when blended therewith.

BACKGROUND OF INVENTION

Hydrophobizing agents are widely used as water repellent materials to impart water resistance to such compositions as textiles, carpet fibers, paper and paperboard when applied thereon. Many materials are known in the art to be useful as hydrophobizing agents for water repellency applications including organometallic complexes, waxes and wax-metal emulsions, resin-based finishes, silicones, rosin, alkylketene dimers, and fluoro chemicals to name a few. A general review of the many uses and types of water repellent chemicals useful as hydrophobizing agents is provided by M. Hayek in the *Encyclopedia of Chemical Technology*, Volume 24, (1984), "Waterproofing and Water/Oil Repellency", pages 442 through 465 and is incorporated herein by reference.

It is well known in the art that many hydrophobizing agents can be stabilized in aqueous dispersion form by the presence of surfactants, usually fatty acid salts, or salts of sulfated fatty alcohols, in order to facilitate their handling and application onto materials, especially at surfaces or at interfaces, for the purpose of imparting water repellency. Such dispersions typically contain relatively high concentrations of surfactant and/or protective colloids as dispersion stabilizers, typically greater than 10% by weight based on hydrophobizing agent, the presence of which surfactants or protective colloid dispersion stabilizers, while providing the necessary colloidal stability for practical preparation of such aqueous dispersions, and while providing the necessary surface activity to ensure deposition of the hydrophobizing agent at surfaces or interfaces, can detract from the repellency properties desired upon final application. This results from the presence of the usually hygroscopic surfactant or protective colloid dispersion stabilizer in the resulting water repellent layer, which can promote rewetting and swelling of the deposited hydrophobizing agent in the presence of water or water vapor. In the case of reactive hydrophobizing agents such as fatty acid anhydrides, alkylketene dimers, and alkenylsuccinic anhydrides, all capable of forming covalent bonds with active hydrogen-containing substrates, the high levels of dispersion stabilizers required for colloidal stability can further interfere with the covalent reactions anchoring the repellent to the substrate by competing with the substrate for active sites, in addition to the aforementioned rewetting phenomenon.

In the case of hydrophobizing agents comprising crystalline waxy materials, such as those selected from the group comprising the various natural, mineral, and synthetic waxes; alkylketene dimers such as hexadecylketene dimer; fatty triglycerides such as tristearin or castor wax; or blends of crystalline materials with themselves or with amorphous hydrophobizing agents, substantially higher levels of dispersion stabilizer are frequently required to offset the pronounced negative effect the crystalline nature of the hydrophobizing agent has on dispersion stability. Indeed, attempts to incorporate even low levels of crystalline materials into aqueous dispersions frequently causes an aqueous dispersion of amorphous hydrophobizing agent to gel upon standing. Thus shipping, storage, and handling requirements require that high levels of dispersion stabilizer be used to ensure sufficient colloidal stability to prevent dispersion flocculation, viscosity build, and eventual gelation or solidification, rendering the dispersion less suitable for practical water repellent applications. Nevertheless, crystalline materials provide a high degree of water repellency and it is frequently a goal of manufacturers of hydrophobizing agent dispersions to blend crystalline materials with less costly amorphous materials to achieve a proper balance of economics and high performance. It is therefore desirable to minimize the presence of dispersion stabilizing additives, such as surfactants or protective colloids, in the final water repellent crystalline waxy material-containing hydrophobizing agent dispersion, in order to achieve the greatest efficiency of active ingredient utilization.

One method for providing such colloidal stability, in addition to the aforementioned use of high levels of surfactants, has been to prepare the dispersions in relatively dilute form, usually less than 10% to 20%, by weight based on total dispersion, of hydrophobizing agent. While this may provide sufficient stability for many applications, it can also lead to inefficiencies in storage and shipping since the quantity of inactive ingredient, water, becomes excessively large requiring surplus storage facilities and shipping containers for what amounts to low levels of useful or active ingredient. It is therefore also desirable to maximize the concentration of hydrophobizing agent in the dispersion to provide the greatest efficiency of storage and least costly method of transport.

One attempt to overcome the disadvantages that high levels of surfactants bring to aqueous wax emulsions is described in U.S. Pat. No. 3,432,319, which discloses paraffin wax emulsion compositions comprising relatively low concentrations of a hydroxyalkyl methylcellulose ether dispersion stabilizer. Several advantages associated with the absence of conventional surfactants and the use of high aqueous concentrations of wax are disclosed including increased mechanical shear stability and increased compatibility with urea-formaldehyde resins. However the hydrophobizing wax material is restricted to paraffin wax. Indeed, in contrast to the instant invention, partial substitution of the paraffin wax with a crystalline non-reactive waxy hydrophobic material such as tristearin, or a crystalline reactive waxy material such as hexadecylketene dimer, according to said patent, leads to difficulty in emulsifying the mixture or instability in the resulting dispersion. Thus the benefit of the dispersions as disclosed is restricted to those consisting of paraffin waxes alone.

One attempt at improving the colloidal stability, for storage and handling purposes, of dispersions containing crystalline hydrophobizing agents is disclosed in U.S. Pat. No. 4,296,012, which describes the requirements of utilizing a non-crystalline hydrocarbon resin in combination with a crystalline ketene dimer in order to achieve the appropriate amount of stability in the ketene dimer dispersion, while providing a high degree of sizing effect. However, the dispersions are relatively dilute, typically 15% by weight of total dispersion of non-volatile component and contain a high concentration of dispersion stabilizer, typically greater than 20% by weight based on concentration of hydrophobizing agent. In contrast, the dispersions of the instant invention are stable in the presence of crystalline materials alone, even at concentrations of hydrophobizing agent up to about 50% by weight of total dispersion.

A combination of a cationic dispersing agent and alkyl hydroxyalkyl cellulose, as dispersion stabilizers for substituted ketene dimer dispersions, is disclosed in U.S. Pat. No. 3,931,069. The dispersions are useful for sizing cellulose fibers and contain up to 30%, by weight, of total solids content. However the total solids content represents the combined concentrations of the ketene dimer and the stabilizers, making the highest attainable solids content of the ketene dimer, i.e. the hydrophobizing agent, based on weight of total dispersion, significantly less than 30%. In contrast, the dispersions of the instant invention readily achieve hydrophobizing agent concentrations in excess of 40% by weight of total dispersion.

Furthermore, it had been disclosed and claimed in U.S. Pat. No. 2,627,477 that aqueous emulsions of higher ketene dimers containing a water-soluble cellulose ether are useful in sizing paper. However the examples teach that very high levels of water-soluble cellulose ether relative to ketene dimer, up to as much as 300% by weight of stabilizer based on ketene dimer or greater, must be employed. The resulting dispersions themselves are very dilute, typically 0.5% by weight of ketene dimer based on total dispersion, and describe pre-dissolution of the dimer in an organic solvent. In contrast, the dispersions of the instant invention readily achieve a high degree of stability utilizing dispersions stabilizers at concentrations less than about 10% by weight based on hydrophobizing agent, and hydrophobizing agent concentrations up to about 50% by weight of total dispersion.

U.S. Pat. No. 5,013,775 discloses the difficulty associated with preparation of stable high concentration aqueous dispersion sizing agents based on ketene dimer compounds and suggests a solution whereby a composition comprising a hydrophilic copolymer polymerized in the presence of an alkylmercaptan is utilized to stabilize the hydrophobic ketene dimer compounds in aqueous dispersion form. The resulting dispersions are clearly distinguishable from the dispersions of the instant invention in that they typically contain about 20% dispersion stabilizer by weight of ketene dimer, at total non-volatile solids of 20% by weight of total dispersion.

U.S. Pat. No. 5,028,236 describes ketene dimer dispersions useful for the treatment of wool and synthetic polyamide fibers. The dispersions of said invention are dilute, being less than about 10% by weight of total dispersion of hydrophobizing agent.

U.S. Pat. No. 5,403,392, by the current author, describes high solids dispersions of hydrophobizing agents stabilized in aqueous dispersion form by plant glycosides. The dispersions of said patent are readily stable upon storage at ambient conditions and achieve hydrophobizing agent concentrations of up to about 40% by weight of total dispersion, versus about 50% by weight of total dispersion of hydrophobizing agent according to the instant invention.

In addition to these references, several other U.S. patents describe methods of producing high solids wax dispersions. For instance, U.S. Pat. No. 2,172,392 discloses that stable high solids wax emulsions can be produced in the presence of high levels of protein materials such as casein. Salts such as sodium carbonate are used to solubilize the protein materials in water via ionization of their carboxyl groups, enabling the protein's emulsifying properties to be manifested. Very high levels of emulsifier are used to achieve the desired effect.

U.S. Pat. No. 2,536,018 relates to aqueous polyvinyl acetate coating compositions modified by blending with wax emulsions to achieve improvements in wear-resistance to objects coated therewith. Wax emulsions stabilized with fatty acid soaps are described.

U.S. Pat. No. 2,658,004 describes blends of wax emulsions and mica dispersions useful as last slips. No special requirements concerning the manufacture of the wax emulsion component nor of the mica dispersion component of the resulting blend are disclosed.

Finally, a detailed description of the complex considerations necessary in the design of stable industrial emulsions, including wax emulsions, is provided by W. C. Griffin in the *Encyclopedia of Chemical Technology*, Volume 8, (1979), "Emulsions", pages 900 through 930. This reference discloses that wax emulsions, i.e. dispersions, may be stabilized against agglomeration by buffering with an organic ester, although no details are given.

In none of the aforementioned references is the unique combination of high wax or wax blend solids, with low emulsifier content and high stability, described which would anticipate the advantages achieved according to the instant invention, specifics of which are provided below.

DESCRIPTION OF INVENTION

It is an object of this invention to provide aqueous dispersions of hydrophobizing agents containing low levels of dispersion stabilizers relative to the concentration of hydrophobizing agent, to allow for an increased efficacy of the hydrophobizing agent in its end use application. It is an additional object of this invention to provide stable high solids aqueous dispersions of said hydrophobizing agents for the purpose of minimizing secondary costs and inefficiencies associated with dilute dispersions, such as shipping and storage costs, and for maximizing dispersion stability under thermal cycling conditions typically encountered by current commercially available hydrophobizing agent dispersions during transport and storage. It is further an object of this invention to provide aqueous dispersions of hydrophobizing agents wherein the hydrophobizing agent can be a blend of different hydrophobic materials, in particular wherein at least one of the blended materials is normally at least partially crystalline at room temperature, in order to allow for the optimization of the waterproofing/repellency effect desired. Lastly, it is an object of this invention to provide aqueous dispersions of hydrophobizing agents which are compatible when mixed with synthetic resin emulsions or hydrophobizing agent dispersions of different composition. These and other advantages of the present invention will be made obvious to those skilled in the art from the detailed description provided below.

It has been discovered that stable high solids aqueous dispersions of hydrophobizing agents can be prepared utilizing water-soluble protective colloids in combination with hydrolytically stable water-insoluble organic compounds selected from the group comprising organic salts and polar group-containing organic compounds. Aqueous dispersions based on such combinations unexpectedly achieve high levels of storage stability under conditions of thermal cycling, at hydrophobizing agent concentrations of up to 50% or greater by weight based on total dispersion. These dispersions typically contain from about 0.1% by weight of hydrophobizing agent up to about 5% by weight based on hydrophobizing agent of water-soluble protective colloid, more preferably from about 0.25% by weight of hydrophobizing agent up to about 4% by weight based on hydrophobizing agent of water-soluble protective colloid, most preferably from about 0.5% to about 3% by weight of hydrophobizing agent of water-soluble protective colloid, and from about 0.01% up to about 5% by weight of hydrophobizing agent of a hydrolytically stable water-insoluble organic compound. These dispersions are stable to storage and pumping, and possess remarkable stability to thickening, solidification or coagulation at storage temperatures above 30° C., especially under thermal cycling conditions between ambient temperatures and 34° C.; temperature conditions known in the art to pose particular stability problems for wax dispersions, and known to be frequently reached under typical storage conditions encountered during commercial shipment and storage of wax dispersions. The low concentration of water-soluble protective colloid utilized according to this invention provides a dispersion which is also efficient in imparting hydrophobic characteristics to substrates, by circumventing the rewetting of the protective hydrophobic layer resulting from the use of high levels of dispersion stabilizers, and by minimizing competing side reactions in the case of reactive hydrophobizing agents.

While a wide range of water-soluble protective colloid dispersion stabilizers are useful for the instant invention, such as the natural or semi-synthetic water-soluble gums or resins, descriptions of which are provided by Cottrell and Baird, in *Encyclopedia of Chemical Technology*, Volume 12, (1980), "Gums", pages 45 through 66, and by A. S. Teot in *Encyclopedia of Chemical Technology*, Volume 20, (1982), "Resins, Water-Soluble", pages 207 through 230, the contents of which are incorporated herein by reference, and water-soluble addition polymers and copolymers of vinyl monomers, most preferred are natural or semi-synthetic carbohydrate-based protective colloids, such as those selected from the group comprising plant glycosides, including glycosides whose aglycone portion is structurally related to benzopyrone-, triterpenoid-, and steroid-based structures, and water-soluble polysaccharides, including the water-soluble cellulose ethers, such as methyl cellulose, methyl hydroxypropyl cellulose and hydroxypropyl cellulose, and combinations of said water-soluble protective colloids.

A critical aspect to achieve the high level of dispersion stability according to the instant invention is to utilize hydrolytically stable water-insoluble organic compounds in combination with the aforementioned water-soluble protective colloids. Hydrolytically stable water-insoluble organic compounds useful as costabilizers in combination with water-soluble protective colloids in the dispersions of the instant invention are those organic compounds whose solubility in water at room temperature is less than about 0.1% by weight based on total solution. Typical examples include those hydrolytically stable water-insoluble compounds selected from the group comprising organic salts and polar group-containing organic compounds such as multivalent cation salts of carboxylic acids, multivalent anion salts of organic amines, alcohols, silicone oils, complexes of organic acids and organic bases, and amides. Specific examples of these materials comprise aluminum, calcium, magnesium, zinc, tin(II) and organic polyamine salts of C-6 or greater monocarboxylic acids or C-2 or greater polycarboxylic acids; polycarboxylic acid salts of C-6 or greater primary, secondary, tertiary, or quaternary organic amines or polyamines; fatty and triglyceride alcohols; alkylated phenols; polydimethyl siloxanes; complexes of C-6 or greater organic acids with C-6 or greater organic amines; and fatty amide waxes. More preferred are materials selected from the group comprising multivalent metal ion fatty acid salts, castor oil and polymerized castor oil and hydrogenated derivatives thereof, tocopherols, polydimethyl silanols, and ethylenebis stearamide. Most preferred are materials selected from the group comprising aluminum, calcium, magnesium, zinc, and tin(II) salts of lauric, palmitic, stearic, oleic, linoleic, linolenic, behenic, and erucic acids; castor oil and polymerized castor oils; castor waxes; Vitamin E; and hydroxy-terminated polysiloxanes. These materials are utilized at concentrations ranging up to about 5% by weight based on hydrophobizing agent concentration, but can be effective at concentrations considerably less than 5% by weight based on hydrophobizing agent concentration depending on the specific material.

While not wishing to be restricted to any one theory, it is believed that the water-insoluble organic compounds of the instant invention do not enter appreciably into either the hydrophobizing agent or aqueous phase during hydrophobizing agent emulsification, but rather form a layer at the hydrophobizing agent/water interface contributing to dispersion stability. Of interest is the determination that water-insoluble inorganic materials, such as calcium sulfate, talc, silica, and zinc oxide, well known in the art to impart stability to mineral oil-in-water emulsions, do not impart thermal storage stability to hydrophobizing agent dispersions when used according to the instant invention as replacements for the water-insoluble organic compounds described above.

It is well known in the art to utilize combinations of dispersion stabilizers in order to fine tune the characteristics of the resulting aqueous dispersion for viscosity and ease of application. Thus, the present invention contemplates also the use of combinations of water-soluble protective colloids and water-insoluble organic compounds, together with secondary dispersion stabilizers, such as traditional surfactants known in the art, including anionic, cationic, nonionic, and amphoteric surfactants. It is additionally known in the art to use water-soluble thickeners or rheology modifiers in combination with primary dispersion stabilizers, to modify the rheological characteristics of the dispersion, as well as to minimize the concentration of required primary stabilizer necessary to achieve the required dispersion stability. Water-soluble polymers useful as secondary dispersion stabilizers are the natural and synthetic materials known in the art to provide the aforementioned characteristics, including water-soluble addition polymers and copolymers of vinyl monomers, and semi-synthetic and natural gums. Water-soluble polymers are generally useful as secondary stabilizers at concentrations equal to or less than that of the primary stabilizer.

Hydrophobizing agents contemplated by the present invention are those materials which are non-migratory upon application and which provide some lasting degree of water repellency under ambient conditions, subsequent to application to the surface or available interfaces of a given material. This excludes hydrophobic materials, such as volatile organic compounds, non-reactive low viscosity materials, or solvents which would not be expected to be substantive to the substrate, either due to volatility or diffusivity, thus preventing the imparting of any lasting water repellency. Suitable examples of hydrophobizing agents useful for the instant invention include triglycerides, especially normally solid or semi-solid triglycerides such as those derived from animal and plant sources including triglycerides derived from the following fatty acids: lauric, myristic, palmitic, stearic, oleic, linoleic, linolenic, alpha-eleostearic, ricinoleic, behenic, and erucic; as well as triglyceride derivatives including hydrogenated triglycerides or saturated triglycerides such as trilaurin, tripalmitin, trimyristin, tristearin, and castor wax, additional examples of which are contained in *Encyclopedia of Chemical*

*Technology*, Volume 9, (1980), "Fats and Fatty Oils", by T. Applewhite, pages 795 through 831, incorporated herein by reference; waxes, i.e. materials which are plastic solids at room temperature, but yield low viscosity fluids upon melting, and which may be crystalline or amorphous, comprising such materials as insect and animal waxes including beeswax and spermaceti, vegetable waxes including candelilla wax, carnauba wax, castor wax, and bayberry wax, mineral waxes including montan wax and petroleum waxes, synthetic waxes such as polyethylene waxes and carboxylated polyethylene waxes, and other waxy materials such as fatty acids, fatty alcohols, fatty acid esters, rosin acids and rosin acid esters, many of these examples being described in *Encyclopedia of Chemical Technology*, Volume 24, (1984), "Waxes", by C. S. Letcher, pages 466 through 481, incorporated herein by reference; reactive hydrophobizing agents including alkylketene dimers, carboxylic acid anhydrides, and alkenylsuccinic anhydrides, capable of covalent attachment to a substrate via reaction with active hydrogen containing groups therein; and other suitable reactive or non-reactive hydrophobic materials such as 1-alkenyl olefins, hydrogenated aromatic petroleum hydrocarbon resin, petrolatum, petroleum asphalt, pentaerythritol tetrastearate, petroleum alicyclic hydrocarbon resins, polyethylene-maleic anhydride adducts, contained in *Code of Federal Regulations*, Title 21, Chapter 1, parts 176.170 and 176.180, the details of which are incorporated herein by reference. It is known in the art that a number of these hydrophobizing agents comprise materials which are at least partially crystalline at room temperature. In addition, such hydrophobizing agents can be combined with each other or with other hydrophobic materials, including antioxidants, mold release agents, and other processing additives, particularly via blending of the dispersion form of said materials, in order to provide dispersions with further specific advantages for a given application, while retaining the ability to impart water repellency.

Several unexpected but especially useful advantages accrue from the dispersions of the instant invention. First, stable high solids dispersions of reactive crystalline alkylketene dimers can be produced according to the instant invention; something which has heretofore been difficult to achieve, especially at the low levels of dispersion stabilizer utilized according to the instant invention. Alkylketene dimer compounds are inherently reactive with water, yielding non-reactive by-products leading to inhomogeneities and colloidal instability in the dispersion. In addition, reactive hydrophobizing agents such as alkylketene dimers are of particular utility not only in their ability to impart water repellent characteristics, but also in that they are so difficult to stabilize in dispersion form that they provide a good screening test for dispersion technology useful for a wide range of hydrophobizing agent compositions. Thus particularly efficacious stabilizer combinations which work for hexadecylketene dimer dispersions frequently work for many other waxy materials. Second, stable high solids dispersions of blends of alkylketene dimers with other hydrophobic materials, including but not restricted to crystalline waxy materials such as saturated triglycerides and waxes, can be produced according to the instant invention at the complete range of hydrophobizing agent ratios, providing an opportunity to fully exploit various combinations of hydrophobizing agents to achieve optimized water repellency for a wide range of substrates. Indeed, in the few instances where alkylketene dimers have been disclosed as being combined with other hydrophobic materials in an aqueous dispersion, only non-crystalline hydrophobizing agents have been blended with the ketene dimers, as disclosed in U.S. Pat. No. 4,296,012, or only very dilute dispersions can be produced in the case of crystalline materials, such as those compositions assigned to Kao Soap Co., Ltd., in Japanese patents JP 82,101,095; JP 82,101,096; JP 82,112,498; JP 82,112,499; JP 83,087,395; JP 83,087,396; JP 83,091,894; JP 83,091,895; described in *Chemical Abstracts* CA:97:218355u, CA:97:218356v, CA:98:5658d, CA:98:5659e, CA:99:214418k, CA:99:214402a, CA:99:196885d, CA:99:196886e, respectively, incorporated herein by reference; which patents disclose dispersions containing 90.9/9.1 blends of alkylketene dimer with propylene glycol monostearate, sucrose stearate, zinc stearate, tristearin, rice-bran wax, 1,4-butanediol distearate, ethylene glycol distearate, and pentaerythritol tetrastearate, respectively, containing about 13% by weight of total dispersion of the blend of hydrophobizing agents, wherein the second component blended with the ketene dimers constitutes about nine percent of the hydrophobizing agent blend, and wherein the dispersion stabilizer, a surfactant, is utilized at a concentration of about 27% by weight of hydrophobizing agent blend. Third, the unexpected improvement in dispersion stability, particularly at above ambient temperatures, allows the fine tuning of these sterically stabilized dispersions as to dispersion viscosity, particle size, and surface tension.

The dispersions of this invention further display a high degree of compatibility with other aqueous systems and are readily mixed with synthetic resin dispersions without loss of stability of the resulting blend. A review of the many types and applications of synthetic resin emulsions, i.e. dispersions, is provided by H. Warson, in *The Applications of Synthetic Resin Emulsions*, Ernest Benn Limited, London, (1972). Thus it is often desirable to modify the properties of synthetic resin dispersions with aqueous dispersions of waxes in order to achieve a specific end use property. An example is the known modification of polyvinylidene chloride dispersions with wax emulsions in order to achieve a lower coefficient of friction and anti-blocking properties in films coated with the polyvinylidene chloride, for use as snack food packaging. Traditional dispersions based on fatty acid surfactants are not compatible with the low pH at which polyvinylidene chloride dispersions are manufactured and processed. The use of said wax emulsions when blended with polyvinylidene chloride dispersions leads to rapid gelation of the blend. Wax dispersions made according to this invention are completely compatible with such synthetic resin emulsions and readily enable both dispersion processability and desired end use properties. Another example is the modification of paper size dispersions with cationic retention aids, in order to further facilitate the incorporation of the size dispersion into cellulose fibers. Frequently, dispersions based on fatty acid surfactants or standard fatty alcohol sulfates coagulate in the presence of these cationic resins. Dispersions made according this invention are compatible with aqueous solutions of cationic resins affording stable mixtures which can be readily applied for sizing purposes.

The following examples serve to illustrate specific aspects of the instant invention without intending to restrict the scope and spirit of what is claimed. All portions described below are by weight.

EXAMPLE 1

2.0 parts methyl cellulose (2% aqueous solution viscosity 15 cps), predissolved in 380 parts distilled water, 10 parts zinc stearate, predispersed in said methyl cellulose solution, and 210 parts hexadecylketene dimer (melting range 43° to 53° C.) were mixed and heated to 60° C. with agitation, homogenized via ultrasonic treatment at 375 watts for 45 seconds, utilizing a Cole-Parmer High Intensity Ultrasonic Processor (final dispersion temperature 75° C.), then cooled rapidly to room temperature with constant agitation. The mixture was filtered yielding a homogeneous, fluid aqueous dispersion containing 34.9% by weight of total dispersion of hexadecylketene dimer. The dispersion is indefinitely stable to storage at room temperature without visible change in appearance or fluidity and stable to thermal cycling between 34° C. and 15° C. (6 hours at each temperature) for more than ten cycles, without loss of fluidity. A control mixture produced according to the above recipe, but in the absence of zinc stearate, yielded an aqueous dispersion which, while stable to storage at room temperature, thickened considerably after four thermal cycles and failed (solidified) during the fifth cycle. Furthermore, dispersions produced according to the recipe above, but in the presence of additional non-volatile aqueous solutes, per the applicant's co-pending application Ser. No. 08/103,885, yielded aqueous dispersions which were not even stable to storage at room temperature, the mixtures solidifying upon cooling to room temperature subsequent to the homogenization step. This example illustrates an embodiment of the instant invention wherein the water-insoluble organic compound is a transition metal salt of a fatty acid.

EXAMPLE 2

2.0 parts methyl cellulose (2% aqueous solution viscosity 15 cps), predissolved in 320 parts distilled water, 5 parts zinc stearate, predispersed in said methyl cellulose solution, and 270 parts hexadecylketene dimer (melting range 43° to 53° C.) were mixed and heated to 60° C. with agitation, homogenized via ultrasonic treatment at 375 watts for 45 seconds, utilizing a Cole-Parmer High Intensity Ultrasonic Processor (final dispersion temperature 75° C.), then cooled rapidly to room temperature with constant agitation. The mixture was filtered yielding a homogeneous, fluid, aqueous dispersion containing 45.2% by weight of total dispersion of hexadecylketene dimer. The dispersion is indefinitely stable to storage at room temperature without visible change in appearance or fluidity and stable to thermal cycling between 34° C. and 15° C. (6 hours at each temperature) for four cycles before solidifying to a hard waxy mixture during the fifth cycle. A control dispersion produced according to the above recipe, but in the absence of zinc stearate, yielded an aqueous dispersion which was stable to storage at room temperature but failed (solidified) during the first thermal cycle. This example illustrates an embodiment of the instant invention wherein the hydrophobizing agent concentration is above 40% by weight of total dispersion.

EXAMPLE 3

2.0 parts methyl cellulose (2% aqueous solution viscosity 15 cps), 1.0 part sodium dioctyl sulfosuccinate (75% in ethanol/water mixture) predissolved in 380 parts distilled water, 5 parts zinc stearate, predispersed in said aqueous solution, and 210 parts hexadecylketene dimer (melting range 43° to 53° C.) were mixed and heated to 60° C. with agitation, homogenized via ultrasonic treatment at 375 watts for 45 seconds, utilizing a Cole-Parmer High Intensity Ultrasonic Processor (final dispersion temperature 75° C.), then cooled rapidly to room temperature with constant agitation. The mixture was filtered yielding a homogeneous, fluid, aqueous dispersion containing 35.1% by weight of total dispersion of hexadecylketene dimer. The dispersion is indefinitely stable to storage at room temperature without visible change in appearance or fluidity and stable to thermal cycling between 34° C. and 15° C. (6 hours at each temperature) for four cycles but failed (solidified) to a hard waxy mixture during the fifth cycle. A control dispersion produced according to the above recipe, but in the absence of zinc stearate, yielded an aqueous dispersion which was stable to storage at room temperature but failed (solidified) during the first thermal cycle. This example illustrates an embodiment of the instant invention wherein a surface active secondary dispersion stabilizer is utilized.

EXAMPLE 4

2.0 parts methyl cellulose (2% aqueous solution viscosity 15 cps), 1.0 part sodium salt of sulfonated naphthalene-formaldehyde condensate predissolved in 350 parts distilled water, 6.5 parts zinc stearate, predispersed in said aqueous solution, and 240 parts hexadecylketene dimer (melting range 43° to 53° C.) were mixed and heated to 55° C. with agitation, homogenized via ultrasonic treatment at 375 watts for 45 seconds, utilizing a Cole-Parmer High Intensity Ultrasonic Processor (final dispersion temperature 68° C.), then cooled rapidly to room temperature with constant agitation. The mixture was filtered yielding a homogeneous, fluid, aqueous dispersion containing 40.0% by weight of total dispersion of hexadecylketene dimer. The dispersion is indefinitely stable to storage at room temperature without visible change in appearance or fluidity and stable to thermal cycling between 34° C. and 15° C. (6 hours at each temperature) for ten cycles without loss of fluidity. A control dispersion produced according to the above recipe, but in the absence of zinc stearate, yielded an aqueous dispersion which was stable to storage at room temperature but failed (solidified) during the first thermal cycle. This example illustrates an embodiment of the instant invention wherein the secondary dispersion stabilizer is an organic dispersing agent.

EXAMPLE 5

2.0 parts methyl cellulose (2% aqueous solution viscosity 15 cps), 1.0 part Saponin Quillaia extract predissolved in 350 parts distilled water, 6.0 parts zinc stearate, predispersed in said aqueous solution, and 240 parts hexadecylketene dimer (melting range 43° to 53° C.) were mixed and heated to 60° C. with agitation, homogenized via ultrasonic treatment at 375 watts for 45 seconds, utilizing a Cole-Parmer High Intensity Ultrasonic Processor (final dispersion temperature 75° C.), then cooled rapidly to room temperature with constant agitation. The mixture was filtered yielding a homogeneous, fluid, aqueous dispersion containing 40.0% by weight of total dispersion of hexadecylketene dimer. The dispersion is indefinitely stable to storage at room temperature without visible change in appearance or fluidity and stable to thermal cycling between 34° C. and 15° C. (6 hours at each temperature) for ten cycles without loss of fluidity. A control dispersion produced according to the above recipe, but in the absence of zinc stearate, yielded an aqueous dispersion which was stable to storage at room temperature but failed (solidified) during the fourth thermal cycle. This example illustrates an embodiment of the instant invention wherein a blend of a water-soluble protective colloid and a plant glycoside is utilized.

EXAMPLE 6

2.0 parts methyl cellulose (2% aqueous solution viscosity 15 cps), 10.0 parts cationic starch (Amaizo 2187, American Maize Corp.), and 1.0 part sodium salt of sulfonated naphthalene-formaldehyde condensate predissolved in 350 parts distilled water, 5.0 parts zinc stearate, predispersed in said aqueous solution, and 240 parts hexadecylketene dimer (melting range 43° to 53° C.) were mixed and heated to 55° C. with agitation, homogenized via ultrasonic treatment at 375 watts for 45 seconds, utilizing a Cole-Parmer High Intensity Ultrasonic Processor (final dispersion temperature 70° C.), then cooled rapidly to room temperature with constant agitation. The mixture was filtered yielding a homogeneous, fluid, aqueous dispersion containing 39.5% by weight of total dispersion of hexadecylketene dimer. The dispersion is indefinitely stable to storage at room temperature without visible change in appearance or fluidity and stable to thermal cycling between 34° C. and 15° C. (6 hours at each temperature) for more than ten cycles without loss of fluidity. A control dispersion produced according to the above recipe, but in the absence of zinc stearate, yielded an aqueous dispersion which was stable to storage at room temperature but failed (solidified) during the first thermal cycle. This example illustrates an embodiment of the instant invention wherein the dispersions of the instant invention are storage stable in the presence of cationic secondary dispersion stabilizers. Stability at hydrophobizing agent concentrations above 25% based on total dispersion, especially in the presence of combinations of cationic water-soluble polymers, such as cationic starch, and anionic dispersants, such as naphthalene-formaldehyde condensates, are both novel and unobvious per the prior art.

EXAMPLE 7

2.0 parts methyl cellulose (2% aqueous solution viscosity 15 cps), 1.0 part sodium salt of sulfonated naphthalene-formaldehyde condensate, predissolved in 350 parts distilled water, 5.0 parts calcium stearate, predispersed in said aqueous solution, and 240 parts hexadecylketene dimer (melting range 43° to 53° C.) were mixed and heated to 60° C. with agitation, homogenized via ultrasonic treatment at 375 watts for 45 seconds, utilizing a Cole-Parmer High Intensity Ultrasonic Processor (final dispersion temperature 75° C.), then cooled rapidly to room temperature with constant agitation. The mixture was filtered yielding a homogeneous, fluid, aqueous dispersion containing 40.1% by weight of total dispersion of hexadecylketene dimer. The dispersion is indefinitely stable to storage at room temperature without visible change in appearance or fluidity and stable to thermal cycling between 34° C. and 15° C. (6 hours at each temperature) for seven cycles without loss of fluidity. A control dispersion produced according to the above recipe, but in the absence of calcium stearate, yielded an aqueous dispersion which was stable to storage at room temperature but failed (solidified) during the first thermal cycle. This example illustrates an embodiment of the instant invention wherein the water-insoluble organic compound is an alkaline earth metal salt of a fatty acid.

EXAMPLE 8

2.0 parts methyl cellulose (2% aqueous solution viscosity 15 cps) and 1.0 part sodium salt of sulfonated naphthalene-formaldehyde condensate, predissolved in 350 parts distilled water, 5.0 parts ethylenebisstearamide, predispersed in said aqueous solution, and 240 parts hexadecylketene dimer (melting range 43° to 53° C.) were mixed and heated to 55° C. with agitation, homogenized via ultrasonic treatment at 375 watts for 45 seconds, utilizing a Cole-Parmer High Intensity Ultrasonic Processor (final dispersion temperature 72° C.), then cooled rapidly to room temperature with constant agitation. The mixture was filtered yielding a homogeneous, fluid, aqueous dispersion containing 40.1% by weight of total dispersion of hexadecylketene dimer. The dispersion is indefinitely stable to storage at room temperature without visible change in appearance or fluidity and stable to thermal cycling between 34° C. and 15° C. (6 hours at each temperature) for three cycles without loss of fluidity. A control dispersion produced according to the above recipe, but in the absence of ethylenebisstearamide, yielded an aqueous dispersion which was stable to storage at room temperature but failed (solidified) during the first thermal cycle. This example illustrates an embodiment of the instant invention wherein the water-insoluble organic compound is a high melting polar fatty amide wax.

EXAMPLE 9

2.0 parts methyl cellulose (2% aqueous solution viscosity 15 cps) and 1.0 part sodium salt of sulfonated naphthalene-formaldehyde condensate, predissolved in 350 parts distilled water, 2.5 parts stannous oleate, predispersed in said aqueous solution, and 240 parts hexadecylketene dimer (melting range 43° to 53° C.) were mixed and heated to 55° C. with agitation, homogenized via ultrasonic treatment at 375 watts for 45 seconds, utilizing a Cole-Parmer High Intensity Ultrasonic Processor (final dispersion temperature 70° C.), then cooled rapidly to room temperature with constant agitation. The mixture was filtered yielding a homogeneous, fluid, aqueous dispersion containing 40.3% by weight of total dispersion of hexadecylketene dimer. The dispersion is indefinitely stable to storage at room temperature without visible change in appearance or fluidity and stable to thermal cycling between 34° C. and 15° C. (6 hours at each temperature) for more than ten cycles without loss of fluidity. A control dispersion produced according to the above recipe, but in the absence of stannous oleate, yielded an aqueous dispersion which was stable to storage at room temperature but failed (solidified) during the first thermal cycle. This example illustrates an embodiment of the instant invention wherein the water-insoluble organic compound is a high boiling liquid group IVa metal salt.

EXAMPLE 10

2.0 parts methyl cellulose (2% aqueous solution viscosity 15 cps) and 10.0 parts sucrose, predissolved in 350 parts distilled water, 1.0 part castor oil, predispersed in said aqueous solution, and 240 parts hexadecylketene dimer (melting range 43° to 53° C.) were mixed and heated to 55° C. with agitation, homogenized via ultrasonic treatment at 375 watts for 45 seconds, utilizing a Cole-Parmer High Intensity Ultrasonic Processor (final dispersion temperature 70° C.), then cooled rapidly to room temperature with constant agitation. The mixture was filtered yielding a homogeneous, fluid, aqueous dispersion containing 39.8% by weight of total dispersion of hexadecylketene dimer. The dispersion is indefinitely stable to storage at room temperature without visible change in appearance or fluidity and stable to thermal cycling between 34° C. and 15° C. (6 hours at each temperature) for six cycles without loss of fluidity. A control dispersion produced according to the above recipe, but in the absence of castor oil, yielded an aqueous dispersion which was stable to storage at room temperature but failed (solidified) during the fourth thermal cycle. This example illustrates an embodiment of the instant invention wherein the water-insoluble organic compound is a water-insoluble alcohol.

EXAMPLE 11

1.0 part methyl cellulose (2% aqueous solution viscosity 15 cps) and 1.0 part 30% by weight aqueous solution of sodium lauryl sulfate, predissolved in 200 parts distilled water, 3.0 parts castor oil, predispersed in said aqueous solution, and 200 parts hexadecylketene dimer (melting range 43° to 53° C.) were mixed and heated to 55° C. with agitation, homogenized via ultrasonic treatment at 375 watts for 45 seconds, utilizing a Cole-Parmer High Intensity Ultrasonic Processor (final dispersion temperature 75° C.), then cooled rapidly to room temperature with constant agitation. The mixture was filtered yielding a homogeneous, fluid, aqueous dispersion containing 49.4% by weight of total dispersion of hexadecylketene dimer. The dispersion is indefinitely stable to storage at room temperature without visible change in appearance or fluidity and stable to thermal cycling between 34° C. and 15° C. (6 hours at each temperature) for six cycles without loss of fluidity. A control dispersion produced according to the above recipe, but in the absence of castor oil, yielded an aqueous dispersion which was stable to storage at room temperature but failed (solidified) during the first thermal cycle. This example illustrates an embodiment of the instant invention wherein the water-insoluble organic compound is a water-insoluble alcohol and wherein the hydrophobizing agent solids is close to 50% by weight of total dispersion.

EXAMPLE 12

2.0 parts methyl cellulose (2% aqueous solution viscosity 15 cps) and 10.0 parts sucrose, predissolved in 350 parts distilled water, 10.0 parts castor wax, predispersed in said aqueous solution, and 240 parts hexadecylketene dimer (melting range 43° to 53° C.) were mixed and heated to 55° C. with agitation, homogenized via ultrasonic treatment at 375 watts for 45 seconds, utilizing a Cole-Parmer High Intensity Ultrasonic Processor (final dispersion temperature 70° C.), then cooled rapidly to room temperature with constant agitation. The mixture was filtered yielding a homogeneous, fluid, aqueous dispersion containing 39.2% by weight of total dispersion of hexadecylketene dimer. The dispersion is indefinitely stable to storage at room temperature without visible change in appearance or fluidity and stable to thermal cycling between 34° C. and 15° C. (6 hours at each temperature) for ten cycles without loss of fluidity. A control dispersion produced according to the above recipe, but in the absence of castor wax, yielded an aqueous dispersion which was stable to storage at room temperature but failed (solidified) during the fourth thermal cycle. This example illustrates an embodiment of the instant invention wherein the water-insoluble organic compound is a water-insoluble alcohol and wherein high levels of water-insoluble alcohol provide a further increase in stability (see EXAMPLE 10 for comparison).

EXAMPLE 13

2.0 parts methyl cellulose (2% aqueous solution viscosity 15 cps) and 1.0 part trisodium phosphate dodecahydrate, predissolved in 350 parts distilled water, 1.0 part D,L α-tocopherol, predispersed in said aqueous solution, and 240 parts hexadecylketene dimer (melting range 53° to 58° C.) were mixed and heated to 60° C. with agitation, homogenized via ultrasonic treatment at 375 watts for 45 seconds, utilizing a Cole-Parmer High Intensity Ultrasonic Processor (final dispersion temperature 75° C.), then cooled rapidly to room temperature with constant agitation. The mixture was filtered yielding a homogeneous, fluid, aqueous dispersion containing 40.4% by weight of total dispersion of hexadecylketene dimer. The dispersion is indefinitely stable to storage at room temperature without visible change in appearance or fluidity and stable to thermal cycling between 34° C. and 15° C. (6 hours at each temperature) for ten cycles without loss of fluidity. A control dispersion produced according to the above recipe, but in the absence of D,L α-tocopherol, yielded an aqueous dispersion which was stable to storage at room temperature but failed (solidified) during the fourth thermal cycle. This example illustrates an embodiment of the instant invention wherein the water-insoluble organic compound is a water-insoluble alkyl phenol.

EXAMPLE 14

2.0 parts methyl cellulose (2% aqueous solution viscosity 15 cps) and 1.0 part trisodium phosphate dodecahydrate, predissolved in 350 parts distilled water, 3.0 part 3,000 M.W. hydroxy-terminated polydimethylsiloxane, predispersed in said aqueous solution, and 240 parts hexadecylketene dimer (melting range 53° to 58° C.) were mixed and heated to 60° C. with agitation, homogenized via ultrasonic treatment at 375 watts for 45 seconds, utilizing a Cole-Parmer High Intensity Ultrasonic Processor (final dispersion temperature 75° C.), then cooled rapidly to room temperature with constant agitation. The mixture was filtered yielding a homogeneous, fluid, aqueous dispersion containing 40.3% by weight of total dispersion of hexadecylketene dimer. The dispersion is indefinitely stable to storage at room temperature without visible change in appearance or fluidity and stable to thermal cycling between 34° C. and 15° C. (6 hours at each temperature) for eight cycles without loss of fluidity. A control dispersion produced according to the above recipe, but in the absence of polydimethylsiloxane, yielded an aqueous dispersion which was stable to storage at room temperature but failed (solidified) during the fourth thermal cycle. This example illustrates an embodiment of the instant invention wherein the water-insoluble organic compound is a hydroxy-containing silicone oil.

EXAMPLE 15

3 parts of the dispersion described in Example 1 were mixed with 100 parts of a 50% aqueous dispersion of vinylidene chloride/methyl methacrylate copolymer with slow stirring. The blend was stable to storage and could be readily coated onto polyolefin film.

The dispersions of this invention efficiently impart hydrophobic characteristics to the surfaces and interfaces of substrates onto which they are applied, as well as to films cast from synthetic resin emulsions modified through blending with said dispersions. It will be obvious to those skilled in the art that many modifications can be made to the instant invention, descriptions of which were not specifically included in the preceding written disclosure without departing from the spirit and scope of what is claimed below.

What I claim is:

1. A composition of matter which is an aqueous hydrophobizing agent dispersion comprising:

a) from about 0.01% up to about 5% by weight of hydrophobizing agent of a water-soluble protective colloid selected from the group consisting of plant glycosides, semi-synthetic water-soluble polysaccharides and blends thereof, b) from about 0.01% up to about 5% by weight of hydrophobizing agent of a hydrolytically stable water-insoluble organic compound selected from the group comprising organic salts and polar group-containing organic compounds, c) optionally a secondary dispersion stabilizer, d) from about 0.1% up to about 50% by weight of total dispersion of a hydrophobizing agent, e) water.

2. The composition of claim 1 wherein the organic salts and polar group-containing organic compounds are selected from the group comprising multivalent cation salts of carboxylic acids, multivalent anion salts of organic amines, alcohols, silicone oils, complexes of organic acids and organic bases, and amides.

3. The composition of claim 2 wherein the multivalent cation salts of carboxylic acids, multivalent anion salts of organic amines, alcohols, silicone oils, complexes of organic acids and organic bases, and amides are selected from the group comprising aluminum, calcium, magnesium, zinc, tin(II) and organic polyamine salts of C-6 or greater monocarboxylic acids or C-2 or greater polycarboxylic acids; polycarboxylic acid salts of C-6 or greater primary, secondary, tertiary, or quaternary organic amines or polyamines; fatty and triglyceride alcohols; alkylated phenols; hydroxy-terminated polysiloxanes; complexes of C-6 or greater organic acids with C-6 or greater organic amines; and fatty amide waxes.

4. The composition of claim 2 wherein the multivalent cation salts of carboxylic acids, multivalent anion salts of organic amines, alcohols, silicone oils, complexes of organic acids and organic bases, and amides are selected from the group comprising multivalent metal ion fatty acid salts, castor oil and polymerized castor oil and hydrogenated derivatives thereof, tocopherols, water-insoluble silanols, and ethylenebis stearamide.

5. The composition of claim 4 wherein the hydrophobizing agent is selected from the group consisting of reactive hydrophobizing agents and blends of reactive hydrophobizing agents with each other and with non-reactive hydrophobizing agents.

6. The composition of claim 1 wherein the organic salts and polar group-containing organic compounds are selected from the group comprising multivalent cation salts of carboxylic acids, multivalent anion salts of organic amines, alcohols, silicone oils, complexes of organic acids and organic bases, and amides.

7. The composition of claim 6 wherein the multivalent cation salts of carboxylic acids, multivalent anion salts of organic amines, alcohols, silicone oils, complexes of organic acids and organic bases, and amides are selected from the group comprising aluminum, calcium, magnesium, zinc, tin(II) and organic polyamine salts of C-6 or greater monocarboxylic acids or C-2 or greater polycarboxylic acids; polycarboxylic acid salts of C-6 or greater primary, secondary, tertiary, or quaternary organic amines; fatty and triglyceride alcohols; alkylated phenols; hydroxy-terminated polysiloxanes; complexes of C-6 or greater organic acids with C-6 or greater organic amines; and fatty amide waxes.

8. The composition of claim 6 wherein the multivalent cation salts of carboxylic acids, multivalent anion salts of organic amines, alcohols, silicone oils, complexes of organic acids and organic bases, and amides are selected from the group comprising multivalent metal ion fatty acid salts, castor oil and polymerized castor oil and hydrogenated derivatives thereof, tocopherols, water-insoluble silanols, and ethylenebis stearamide.

9. The composition of claim 8 wherein the hydrophobizing agent is selected from the group consisting of reactive hydrophobizing agents and blends of reactive hydrophobizing agents with each other and with non-reactive hydrophobizing agents.

10. A blend of the composition of claim 1 and a synthetic resin emulsion.

11. A method for producing a composition of matter which is an aqueous hydrophobizing agent dispersion comprising:

a) from about 0.01% up to about 5% by weight of hydrophobizing agent of a water-soluble protective colloid selected from the group consisting of plant glycosides, semi-synthetic water-soluble polysaccharides and blends thereof, b) from about 0.01% up to about 5% by weight of hydrophobizing agent of a hydrolytically stable water-insoluble organic compound selected from the group comprising organic salts and polar group-containing organic compounds, c) optionally a secondary dispersion stabilizer, d) from about 0.1% up to about 50% by weight of total dispersion of a hydrophobizing agent, and e) water, comprising dispersing said hydrophobizing agent into water in the presence of said water-soluble protective colloid and water-insoluble organic compound to form the aqueous hydrophobizing agent dispersion.

12. The method of claim 11 wherein the organic salts and polar group-containing organic compounds are selected from the group comprising multivalent cation salts of carboxylic acids, multivalent anion salts of organic amines, alcohols, silicone oils, complexes of organic acids and organic bases, and amides.

13. The method of claim 12 wherein the multivalent cation salts of carboxylic acids, multivalent anion salts of organic amines, alcohols, silicone oils, complexes of organic acids and organic bases, and amides are selected from the group comprising aluminum, calcium, magnesium, zinc, tin(II) and organic polyamine salts of C-6 or greater monocarboxylic acids or C-2 or greater polycarboxylic acids; polycarboxylic acid salts of c-6 or greater primary, secondary, tertiary, or quaternary organic amines; fatty and triglyceride alcohols; alkylated phenols; hydroxy-terminated polysiloxanes; complexes of C-6 or greater organic acids with C-6 or greater organic amines; and fatty amide waxes.

14. The method of claim 12 wherein the multivalent cation salts of carboxylic acids, multivalent anion salts of organic amines, alcohols, silicone oils, complexes of organic acids and organic bases, and amides are selected from the group comprising multivalent metal ion fatty acid salts, castor oil and polymerized castor oil and hydrogenated derivatives thereof, tocopherols, water-insoluble silanols, and ethylenebis stearamide.

15. The method of claim 11 wherein the organic salts and polar group-containing organic compounds are selected from the group comprising multivalent cation salts of carboxylic acids, multivalent anion salts of organic amines, alcohols, silicone oils, complexes of organic acids and organic bases, and amides.

16. The method of claim 15 wherein the multivalent cation salts of carboxylic acids, multivalent anion salts of organic amines, alcohols, silicone oils, complexes of organic acids and organic bases, and amides are selected from the group comprising aluminum, calcium, magnesium, zinc, tin(II) and organic polyamine salts of C-6 or greater monocarboxylic acids or C-2 or greater polycarboxylic acids; polycarboxylic acid salts of C-6 or greater primary, secondary, tertiary, or quaternary organic amines; fatty and triglyceride alcohols; alkylated phenols; hydroxy-terminated polysiloxanes; complexes of C-6 or greater organic acids with C-6 or greater organic amines; and fatty amide waxes.

17. The method of claim 15 wherein the multivalent cation salts of carboxylic acids, multivalent anion salts of organic amines, alcohols, silicone oils, complexes of organic acids and organic bases, and amides are selected from the group comprising multivalent metal ion fatty acid salts, castor oil and polymerized castor oil and hydrogenated derivatives thereof, tocopherols, water-insoluble silanols, and ethylenebis stearamide.

18. The method of claim 17 wherein the hydrophobizing agent is selected from the group consisting of reactive hydrophobizing agents and blends of reactive hydrophobizing agents with each other and with non-reactive hydrophobizing agents.

* * * * *